United States Patent [19]

Kii

[11] 4,206,331

[45] Jun. 3, 1980

[54] SELF-GENERATING FLUID-BLAST SINGLE-BREAK CIRCUIT-INTERRUPTER

[75] Inventor: Masami Kii, Amagasaki, Japan

[73] Assignee: Mitsubishi Denki Kabushiki Kaisha, Tokyo, Japan

[21] Appl. No.: 880,537

[22] Filed: Feb. 23, 1978

[30] Foreign Application Priority Data

Mar. 24, 1977 [JP] Japan ..... 52-32936

[51] Int. Cl.[2] ..... H01H 33/98

[52] U.S. Cl. ..... 200/148 R; 200/150 D

[58] Field of Search ..... 200/148 R, 148 A, 148 B, 200/148 C, 148 D, 148 E, 148 F, 148 G, 148 H, 148 J, 148 BV, 150 D, 150 E, 144 R

[56] References Cited

U.S. PATENT DOCUMENTS 2,757,261 7/1956 Lingal et al. ..... 200/148 E

FOREIGN PATENT DOCUMENTS 723209 7/1942 Fed. Rep. of Germany ..... 200/148 R 550301 1/1943 United Kingdom ..... 200/148 R

*Primary Examiner*—J. V. Truhe

*Assistant Examiner*—Morris Ginsburg

*Attorney, Agent, or Firm*—L. P. Johns

[57] ABSTRACT

A self-extinguishing-type of fluid-blast circuit-interrupter is provided, of the single-break type, utilizing a plurality of pressure-generating chambers disposed in series relation, and compartmentalizing the extinguishing chambers so as to act transversely on series portions of the singly-drawn arc.

The two pressure-generating chambers are disposed opposite to the fluid-flow transmitting passages, so that there occurs a desirable reduction in temperature of the pressurized fluid prior to its subsequent injection into the arcing region.

9 Claims, 2 Drawing Figures

CLOSED POSITION

OPENING OPERATION

SELF-GENERATING FLUID-BLAST SINGLE-BREAK CIRCUIT-INTERRUPTER

CROSS-REFERENCES TO RELATED APPLICATIONS

Applicant is not aware of any related patent applications pertinent to the present invention.

BRIEF SUMMARY OF THE INVENTION

According to the present invention, there is provided an arc-extinguishing unit comprising a stationary contact and a cooperable rod-shaped movable contact separable to establish an arc within a plurality of multiple, series, arcing chambers, with each arcing chamber communicating circuitously with a related pressure-generating chamber, the pressure within which being raised by a portion of the arc which is drawn.

The fluid-flow conditions are such as to force a transverse, or perpendicular flow of fluid against segmental portions of the established arc for rapid arc interruption.

DESCRIPTION OF THE PREFERRED EMBODIMENT

Figure 1:
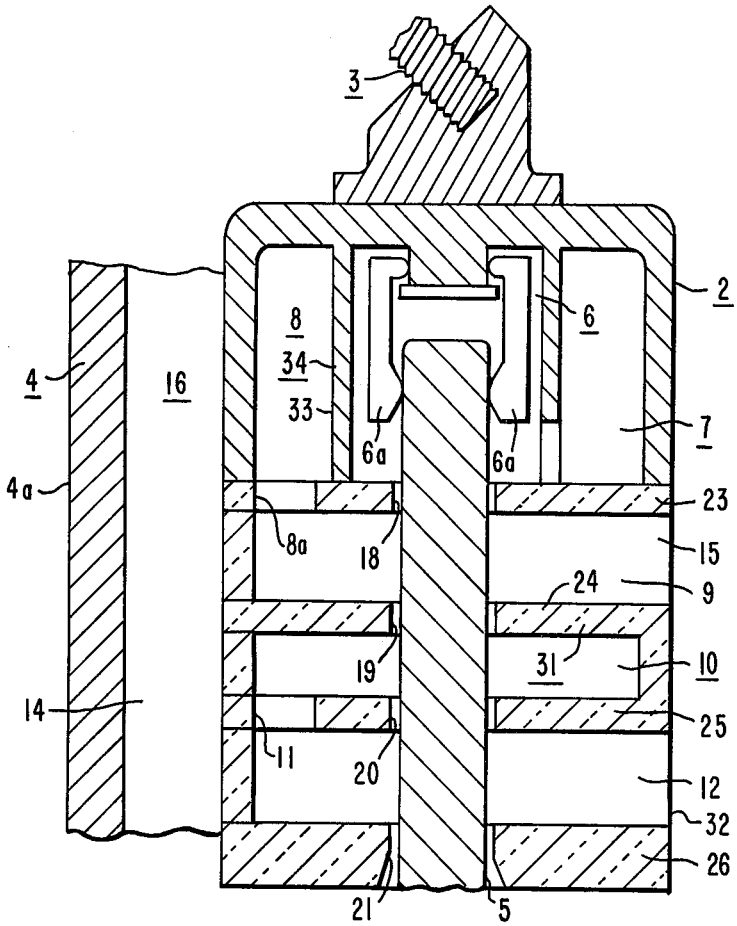
FIG. 1 is a vertical sectional view taken through a fluid-blast circuit-interrupter embodying the principles of the present invention, the contact structure being illustrated in the closed-circuit position; and, FIG. 2 is a view similar to that of FIG. 1, but showing the arcing conditions during the opening operation of the circuit-interrupter, with the direction of fluid-transmission flow therein being indicated.

Referring to the drawings, and more particularly to FIG. 1 thereof, the reference numeral 1 generally designates a fluid-flow type of circuit-interrupter of the self-pressure-generating type, in which an arc-extinguishing grid, or unit structure 2 is supported from the lower end of an upper terminal-bushing 3, for example, and the arc-extinguishing grid structure 2 being disposed within a suitable surrounding enclosure 4, such as a tank, for example, a portion of the wall of which being designated by the reference numeral 4*a*.

FIG. 1 illustrates the device 1 in the closed-circuit position in which a rod-shaped movable contact 5 cooperates with an upper-disposed relatively stationary contact structure 6.

Adjacent to the relatively-stationary contact structure 6 is a laterally-disposed pressure-generating chamber 7, which communicates, by a remote, or somewhat distant passageway 8, that leads through an opening 8*a* to a generally-horizontally-extending first extinction flow passageway 9.

Disposed below the first extinction flow passageway 9 is, preferably, a second, lower-disposed, pressure-generating chamber 10, which again communicates somewhat remotely, by an intercommunicating flow passageway 11, to a second, lower-disposed, generally-horizontally-extending arc-extinguishing flow passage 12.

Figure 2:
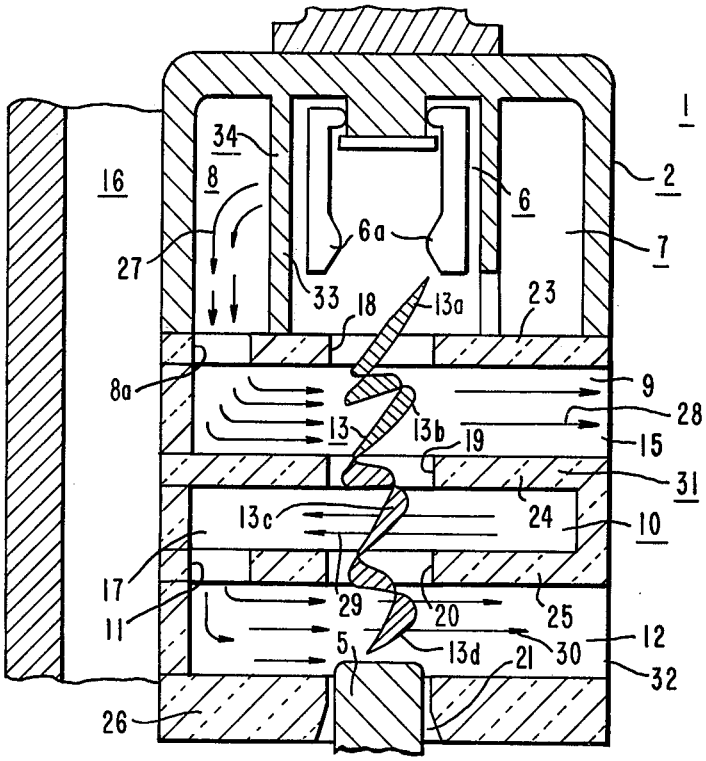

FIG. 1 illustrates the interrupting device 1 in the closed-circuit position; and FIG. 2 illustrates the same device 1 during the opening operation, in which segmental portions 13*a*, 13*b*, 13*c* and 13*d* of the arc 13 react upon the plurality of pressure-generating chambers 7, 10 to produce the desired fluid flow. The fluid 14 is, preferably, a suitable arc-extinguishing gas, such as sulfur-hexafluoride ($SF_6$) gas, for example. The remarkable arc-extinguishing characteristics of this gas are set forth in U.S. Pat. No. 2,757,261, issued July 31, 1956 to Harry J. Lingal et al.

It is desirable to have the entering extinguishing fluid flow within the horizontal passageway 9 be of a relatively-cool temperature, so as to be highly effective in causing diffusion and extinction of the established arc 13 as it approaches its cyclical zero value. As is well known, in an alternating-current circuit, the alternating-current arc diameter 13 fluctuates in accordance with its instantaneous current value; and, appropriately, as the arcing current 13 approaches its zero value, propitious conditions then occur at this time for a proper arc-extinguishing action to occur. It is then at this time that the transversely-flowing fluid 14 under pressure within the passageway 9, caused by the pressure generation within the pressure-generating chamber 7, causes a highly-effective transverse extinguishing fluid-flow action to occur through the arc portion 13*b* and out of the vent opening 15 to the surrounding ambient 16 externally of the arc-extinguishing grid structure 2.

During the existence of severe alternating-current circuit conditions, that is, for example, during high-amperage currents, the utilization of a second, lower-disposed, additional arc-extinguishing flow passageway 12, together with its concomitant pressure-generating chamber 10, causes an additional, second, desirable highly-effective fluid-flow action to take place to thereby assist and to augment the upper-disposed transversely-extending fluid-flow 9.

Thus, the instant invention contemplates, preferably, the use of two generally-horizontally-extending, transversely-directed fluid-flow passageways 9 and 12 to collectively act together upon different series portions 13*b* and 13*d* of the drawn arc 13.

In more detail, it will be observed, with reference to FIG. 1, that there are provided a plurality of vertically-spaced, horizontally-extending, insulating plate members 23–26 having apertures provided therein 18–21 to accommodate the vertical opening and closing movements of the movable rod-shaped contact 5. As shown more clearly in FIG. 2 of the drawings, the establishment of arcing 13 results in a plurality of series arc portions 13*a*, 13*b*, 13*c* and 13*d*, which are subjected to transverse, zig-zag flows of arc-extinguishing fluid in the manner indicated by the arrows 27–30.

Also, it will be noted that, as previously mentioned, the two pressure-generating chambers 7, 10 are so arranged and isolated, in a compartmentalized fashion, from the adjacent transverse flow passageways 9, 12 as to force the two flows 28, 30 in a circuitous fashion prior to the subsequent injection of the thus-cooled fluid 14 into the arc portions 13*b*, 13*d*.

A distinct effort is made in the instant disclosed construction to isolate the pressure-generating chambers 7, 10 from the remote point of fluid-ejection 9, 12. This is more clearly illustrated in FIG. 2, with particular reference being directed to the fluid-flow direction-arrows 27–30.

As shown in FIG. 2, a vertically extending plate-portion 33 constituting a partition means 34 is disposed laterally of the relatively stationary contact structure 6 and ensures that the gas blast flowing from the first pressure-generating chamber 7 traverses a circuitous path.

In addition, fluid flow 17, emanating from the second pressure-generating chamber 10, acts transversely upon a portion 13*d* of the arc column 13 to thereby assist in the overall arc-extinguishing action.

Upon arc interruption, the movable contact rod 5 moves downwardly to its fully-open-circuit position, externally of the arcing grid structure 2, and the surrounding ambient fluid 14 may then recirculate back into the interior of the arc-extinguishing grid structure 2 for the next interrupting operation of the circuit-breaker 1.

During the closing operation, the movable contact rod 5 moves upwardly through the second and first transversely-extending arcing passageways 12 and 9, and ultimately makes closed, contacting engagement with the upper-disposed, relatively-stationary contact fingers 6*a* of the stationary contact structure 6.

Although there has been illustrated and described a specific structure, it is to be clearly understood that the same was merely for the purpose of illustration, and that changes and modifications may readily be made therein by those skilled in the art, without departing from the spirit and scope of the invention.

What is claimed is:

1. A self-extinguishing type of fluid-flow circuit-interrupting structure, comprising, in combination, means defining an arc-extinguishing unit having a relatively stationary contact structure (6) disposed therewithin adjacent one end thereof, a cooperable movable rod-shaped contact (5) movable into and out of contacting engagement with said relatively-stationary contact structure, means defining a first pressure-generating chamber (7) disposed interiorly of said arc-extinguishing unit (2) adjacent said relatively-stationary contact structure and so compartmentalized as to form a circuitous flow passageway (8) to a lower-disposed generally-transversely-extending first flow passageway (9), means for causing the withdrawal of said movable rod-shaped contact (5) through a series of aperture openings (18–21), and means defining a lower-disposed second pressure-generating chamber (10) also having a remote circuitous fluid-flow passageway (17) communicating to a second generally-transversely-extending fluid-flow passage (12) disposed adjacent the other end of said arc-extinguishing unit, whereby a plurality of relatively-cool flows (9,12) of arc-extinguishing fluid will be forced by the resultant pressure conditions generally transversely across an arc column (13) to effect thereby the rapid extinction thereof.

2. The combination according to claim 1, wherein partition means including an insulating plate (23) extending longitudinally of the arc-extinguishing unit (2) and forcing an initial portion (13*a*) of the established arc column (13) to generate pressure at a remote pressure-generating region (7) distant from the fluid-flow passageway (9) which fluid-flow passageway (8) communicates to the first flow passageway (9).

3. The combination according to claim 2, wherein a second insulating plate (31) compartmentalizes the fluid-flow passageway (9) from the lower-disposed second pressure-generating chamber (10).

4. The combination according to claim 3, wherein the second pressure-generating chamber (10) is at a remote and distant location from its communicating fluid-flow passage (17) which strikes the drawn arc (13) transversely thereof adjacent the other end of the arc-extinguishing unit.

5. The combination in a fluid-flow arc-extinguishing unit of a relatively stationary contact means (6) disposed adjacent one end of the unit, a movable cooperable rod-shaped contact (5) making contacting engagement, at times, with said relatively-stationary contact means (6) and moved axially toward the other end of the arc-extinguishing unit during the opening operation, partition means including a plurality of generally-horizontally-disposed insulating plate members (23–26) dividing said arc-extinguishing unit (2) into a plurality of transversely-extending fluid-flow passageways (9,12), said movable rod-shaped contact moving consecutively through said plurality of transversely-extending passageways and externally of said passageways in the fully-open-circuit position of the unit, and means defining a plurality of separate and independent pressure-generating chambers (7, 10) communicating with said plurality of transversely-extending fluid-flow passageways (9, 12), and all of said pressure-generating chambers (7,10) being positioned and located at a remote and distant location from the respective communicating passageways (9, 12) leading from the respective pressure-generating chamber (7, 10) to the respective generally-horizontally-extending fluid-flow passageway (9, 12).

6. A gas-blast circuit-interrupter of the single-break type including, in combination, (a) means defining an arc-extinguishing grid-unit disposed in a gaseous ambient;

(b) means defining a relatively-stationary contact (6) disposed adjacent a first end of said arc-extinguishing grid-unit;

(c) a movable contact rod (5) making at times contacting engagement with said relatively-stationary contact (6) and movable during the opening operation toward a second end of said arc-extinguishing grid-unit;

(d) means defining a plurality of substantially-enclosed, pressure-generating chambers (7,10) arranged in superimposed alignment, with one of said pressure-generating chambers (7,10) disposed adjacent the relatively-stationary contact (6) and at least another of said pressure-generating chambers (10) disposed adjacent said second end of said arc-extinguishing grid-unit;

(e) means defining a substantially-transverse gas-flow passage means (9,12) communicating respectively with each of said plurality of pressure-generating chambers (7,10) and causing the gas to traverse a substantially-U-shaped path to intensify the cooling action exerted thereby;

(f) means defining a plurality of vent openings (15,32) extending transversely out of said arc-extinguishing grid-unit (2) in general alignment with said plurality of pressure-generating chambers (7,10);

(g) means defining a plurality of transversely-extending apertured insulating plate-portions (23-26) having apertures (18–21) therein through which said movable contact rod (5) moves during the opening and closing motions thereof;

(h) a segmental portion (13*a*, 13*c*) of an established arc 13 generating pressure within each of said plurality of pressure-generating chambers (7,10) whereby the arc (13) is subjected to a zig-zag, cross-blast, gaseous extinguishing action tending, in effect, to "tear" the arc (13) laterally apart and thus effect its rapid interruption.

7. The combination according to claim 6, wherein a vertically-extending plate-portion (33) constituting a partition means (34) is disposed laterally of the relatively-stationary contact structure (6) and ensures that the gas blast flowing from the first pressure-generating chamber (7) traverses a circuitous path (27).

8. The combination according to claim 6, wherein the movable contact rod (5) cooperates with the apertures (18–21) in the transversely-extending insulating plate portions (23–26) to result in a fluid-flow valve action, thereby successively uncovering the aforesaid apertures (18–21) in said transversely-extending, insulating plate portions (23–26) so that successive flows of transversely-directed gas ensues.

9. The combination according to claim 6, wherein the second pressure-generating chamber (10) is interposed between two of said vent openings (15,32).

* * * * *